US006154921A

United States Patent [19]

Green et al.

[11] Patent Number: 6,154,921

[45] Date of Patent: Dec. 5, 2000

[54] VACUUM CLEANER

[75] Inventors: Michael Green, London, United Kingdom; Johan Skåntorp, Österskär, Sweden; Fredrik Johansson, Göteborg, Sweden; Stefan Petersson, Västervik, Sweden

[73] Assignee: Aktiebolaget Electrolux, Stockholm, Sweden

[21] Appl. No.: 09/247,257

[22] Filed: Feb. 10, 1999

[30] Foreign Application Priority Data

Feb. 12, 1998 [SE] Sweden ..... 9800405

[51] Int. Cl.[7] ..... A47L 9/32

[52] U.S. Cl. ..... 15/410; 15/327.2; 15/325

[58] Field of Search ..... 15/327.1, 327.2, 15/327.7, 410

[56] References Cited

U.S. PATENT DOCUMENTS

| | | | |
|---|---|---|---|
| 3,023,838 | 3/1962 | Gaudry . | |
| 3,170,185 | 2/1965 | Segesman | 15/327.2 X |
| 3,490,089 | 1/1970 | Lagerstrom | 15/327.2 X |
| 3,858,272 | 1/1975 | Bard et al. | 15/410 X |
| 4,827,562 | 5/1989 | Blase et al. | 15/410 X |
| 5,901,408 | 5/1999 | Miller et al. | 15/410 X |

FOREIGN PATENT DOCUMENTS

| | | |
|---|---|---|
| 197 03 014 A1 | 8/1997 | Germany . |
| 128994 | 8/1950 | Sweden . |

*Primary Examiner*—Chris K. Moore
*Attorney, Agent, or Firm*—Pearne, Gordon, McCoy & Granger LLP

[57] ABSTRACT

This invention relates to a vacuum cleaner having a vacuum cleaner housing and a pivotable handle with a grip portion. The handle is pivotably secured to the vacuum cleaner housing in such a manner that the turning axis of the handle is generally horizontal and perpendicular to the direction of movement of the vacuum cleaner when the vacuum cleaner is in a working position on a horizontal surface. The handle is maintained in a generally vertical position when the vacuum cleaner is in the working position. When an operator lifts the vacuum cleaner housing from the working position using the handle, the vacuum cleaner housing pivots to a substantially vertical position, with the position of the grip portion relative to the operator's hand remaining substantially unchanged during the lifting.

14 Claims, 2 Drawing Sheets

VACUUM CLEANER

BACKGROUND OF THE INVENTION

This invention relates to vacuum cleaners in general, and, in particular, to canister-type vacuum cleaners having a vacuum cleaner housing and a turnable handle with a grip portion, wherein the handle is secured to the vacuum cleaner housing in such a manner that the turning axis of the handle is mainly horizontal and perpendicular to the direction of movement when the vacuum cleaner is in its working position on a horizontal surface.

Handles of the above type, see DE-A1-19703014, are used on so called wet cleaners i.e. vacuum cleaners which in a first step spray a cleaning liquid on a surface and in a second step remove the liquid from the surface. The liquid is distributed to and collected in a tank that is placed below a separate housing enclosing the motor-fan unit. In order to make it possible to remove the housing from the tank, the handle, which normally is placed vertically and hence prevents the unit from being released, can be folded to a horizontal position. This means that the housing can be removed from the tank and the handle can again be brought to a vertical position in order to lift the tank and empty the liquid out of the tank. In order to safeguard that the vacuum cleaner or the tank does not tilt when it is lifted by means of the handle, the vacuum cleaner is designed such that the turning axis of the handle is placed in the same vertical plane as the gravity point of the vacuum cleaner and the tank respectively and somewhat above it.

Handles on conventional canister cleaners, i.e. vacuum cleaners comprising a vacuum cleaner housing enclosing a vacuum source and a dust container and being provided with a hose and a tube shaft that is connected to a nozzle, are usually designed as a fixed part of the vacuum cleaner housing. Such a handle is usually placed above the gravity point of the vacuum cleaner when the vacuum cleaner is in its working position on the floor, or at the front part of the vacuum cleaner housing, i.e., at the end where the hose is connected to the vacuum cleaner housing. Positioning the handle above the gravity point is disadvantageous because the handle is placed near the floor such that the operator is forced to bend heavily in order to reach the handle. This positioning of the handle also means that the vacuum cleaner, which is often stored vertically at its rear part in a broom cupboard or the like, has to be turned to this position before it is inserted into the cupboard, which could be cumbersome for the operator. Positioning the handle at the front part of the vacuum cleaner has the same disadvantages as positioning the handle above the gravity point with regard to accessibility, but facilitates placing the vacuum cleaner vertically in the cupboard since the vacuum cleaner when being lifted by the handle automatically achieves this storing position. This position of the handle also means that the complete vacuum cleaner will come closer to the body of the operator, thereby making it easier to carry.

U.S. Pat. No. 3,023,838 shows a canister cleaner with a turnable handle. The handle, which has an elongated shape, is located on top of the vacuum cleaner and extends in the longitudinal direction of the vacuum cleaner. When the handle is grasped and the vacuum cleaner is lifted, the handle is mainly kept in its horizontal position, whereas the vacuum cleaner housing swings to an inclined position with respect to the vertical. This inclined position is defined by cooperating surfaces on the handle and the vacuum cleaner housing. It is, however, quite obvious that the handle falls back to its original position as soon as the vacuum cleaner is placed on a floor, which means that the operator has to bend down before reaching the handle. The handle does not facilitate storing the vacuum cleaner in a vertical position in a cupboard since the center of gravity is positioned on the wrong side of the contact surface between the vacuum cleaner and the surface when putting the vacuum cleaner on the surface.

The purpose of this invention is to eliminate the drawbacks mentioned above and to create a vacuum cleaner handle that is always easy to reach for the operator, and when the vacuum cleaner is lifted, causes a turning motion of the vacuum cleaner housing from its horizontal working position to a mainly vertical position in order to facilitate transportation and vertical storing of the vacuum cleaner. A further purpose of the invention is to create an arrangement making it simple to mount the handle to the vacuum cleaner housing.

SUMMARY OF THE INVENTION

It therefore would be desirable, and is an advantage of the present invention, to provide a vacuum cleaner having a vacuum cleaner housing and a handle with a grip portion. The handle is pivotably secured to the vacuum cleaner housing in such a manner that the handle is pivotable about a turning axis that is substantially horizontal and perpendicular to the direction of movement of the vacuum cleaner when the vacuum cleaner is in a working position on a horizontal surface. Means are provided for maintaining the handle in a generally vertical position when the vacuum cleaner is in the working position, and for allowing the vacuum cleaner housing to pivot to a substantially vertical position when an operator lifts the vacuum cleaner housing from the working position by grasping the grip portion with a hand and lifting. The position of the grip portion relative to the operator's hand remains substantially unchanged during the lifting of the vacuum cleaner housing.

Also provided in accordance with the present invention is a vacuum cleaner having a housing that includes opposing side walls with openings formed therein. Locking sleeves are rotatably disposed in the openings of the side walls. A handle is provided having opposing ends with projections extending therefrom. The projections are securely received in the locking sleeves, thereby pivotably securing the handle to the housing.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
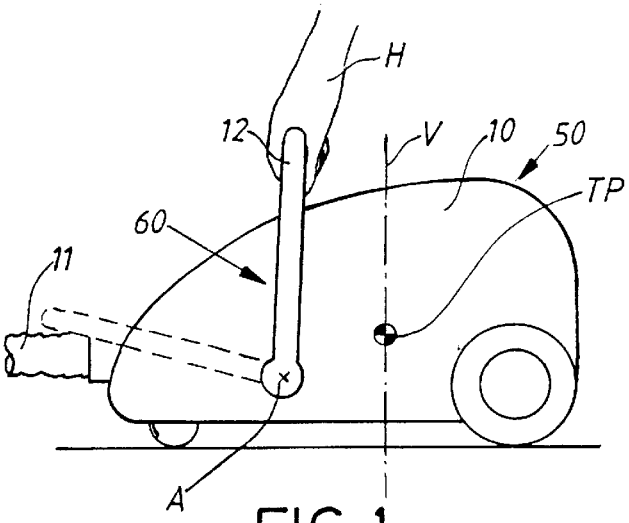
FIG. 1 shows a schematic side view of a vacuum cleaner in a horizontal working position.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
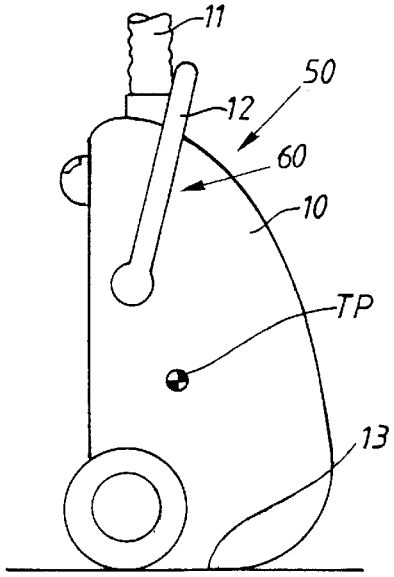
FIG. 2 shows a schematic side view of the vacuum cleaner in a vertical storing position.
Figure 3:
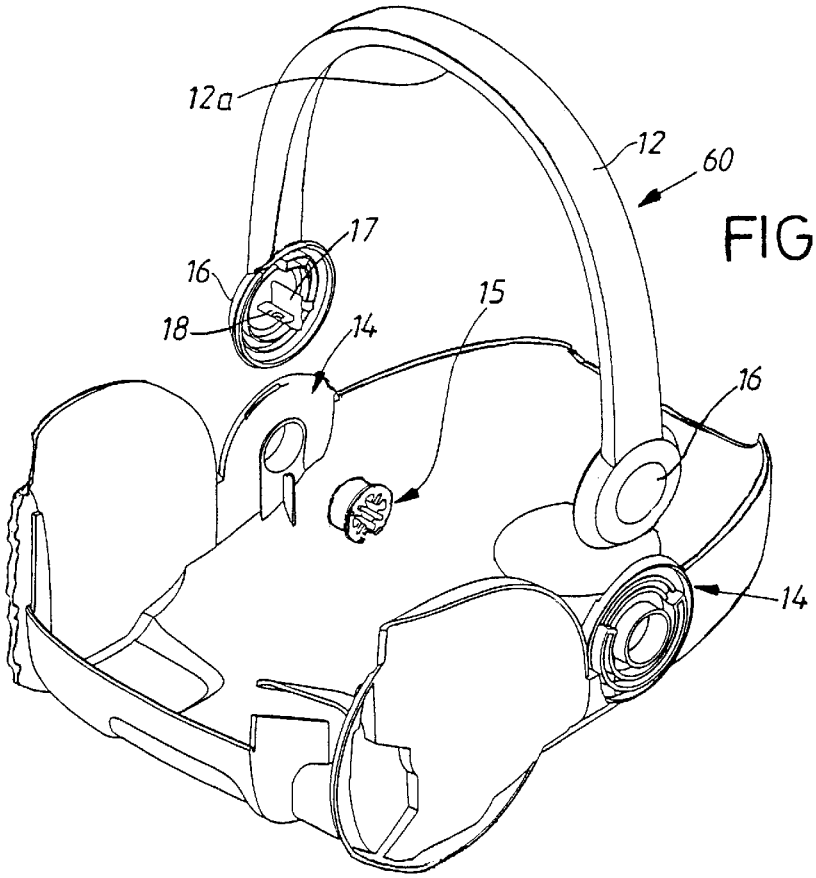
FIG. 3 shows an exploded view of a handle arrangement including a handle.
Figure 4:
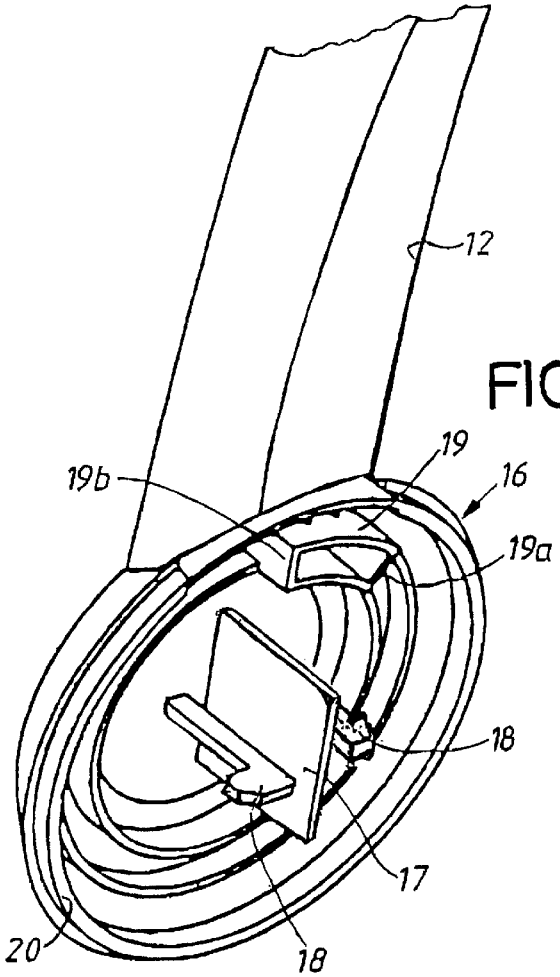
FIG. 4 shows an enlarged perspective view of a portion of the handle.
Figure 5:
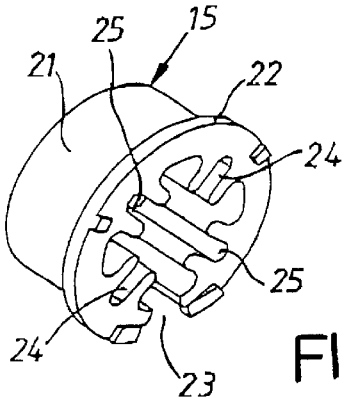
FIG. 5 shows an enlarged perspective view of a locking detail of the handle.
Figure 6:
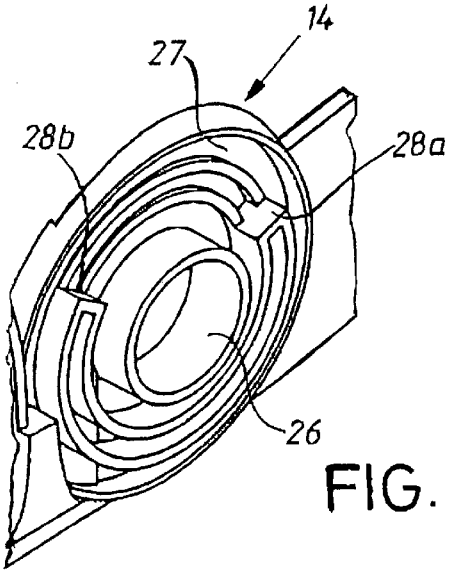
FIG. 6 is an enlarged perspective view of a portion of a housing of the vacuum cleaner (from the opposite side with respect to FIGS. 4 and 5).

Referring now to FIGS. 1 and 2, there is shown a vacuum cleaner 50 having a handle arrangement 60. The vacuum cleaner comprises a vacuum cleaner housing 10, which in a conventional way houses a motor-fan unit (not shown) and a dust container (not shown) whose inlet communicates with a hose 11 connected to a front part of the vacuum cleaner 50. The hose 11 is, in a traditional manner, connected to a tube shaft, which is provided with a nozzle (not shown). The vacuum cleaner 50 is provided with a yoke-shaped handle 12, which is pivotably secured (about an axis A) at each side of the vacuum cleaner housing 10 such that the handle 12 can be moved between a generally horizontal position and a generally vertical position, the horizontal position being indicated by dotted lines in FIG. 1. The handle 12 is provided with a grip portion 12*a* and is fastened to the vacuum cleaner housing 10 at fastening points spaced forwardly from a vertical plane V that is parallel with the turning axis and extends through the gravity point TP of the vacuum cleaner housing 10 when the vacuum cleaner 50 is in its working position on a horizontal surface as shown in FIG. 1. Preferably, said fastening points are also placed somewhat below the gravity point when the vacuum cleaner 50 is in its working position.

The handle arrangement 60 operates in the following manner. When the vacuum cleaner 50 is placed in its working position on a surface, the handle 12 of the vacuum cleaner 50 is kept in its vertical position by friction engagement during the cleaning operation, which means that the grip portion 12*a* of the handle 12 can easily be reached by an operator's hand (H) when the vacuum cleaner 50 is to be lifted again. When the vacuum cleaner 50 is lifted, the vacuum cleaner housing 10 will automatically be turned to the vertical position shown in FIG. 2 because of the position of the gravity point with respect to the fastening points of the handle 12. Thus, the vacuum cleaner 50 can easily be placed on a floor in a vertical position and be stored at its rear part which is designed as a support surface 13. During the turning or swinging motion of the vacuum cleaner 50 when being lifted, the grip portion 12*a* is always placed above the highest point of the vacuum cleaner housing. When the vacuum cleaner 50 is stored, the handle 12 is kept in its vertical position by friction engagement.

It is also possible to pivot the handle 12 to its horizontal position when the vacuum cleaner 50 is being used, which permits the handle 12 to serve as a bumper for the vacuum cleaner housing 10. Since the handle 12 has a rounded shape, the handle 12 facilitates the forward movement of the vacuum cleaner 50 when contacting obstacles.

As shown in FIGS. 3–6, the handle arrangement 60 comprises the handle 12 fastened to supporting portions 14 of the vacuum cleaner housing 10. The handle 12 is locked to the supporting portions 14 by means of locking sleeves 15.

The handle 12 has opposing ends provided with cup-shaped parts 16. Each cup-shaped part 16 houses a tongue 17, two snap fasteners 18 and a shoulder 19 with abutment surfaces 19*a* and 19*b* respectively. Each cup-shaped part 16 also includes a cylinder shaped flange portion 20, disposed proximate (to a periphery of the cup-shaped part 16.

Each locking sleeve 15 comprises a hollow cylinder part 21 having a radially outwardly extending flange 22 at one end. Each locking sleeve 15 is divided by means of an axially extending groove 23 and has opposite, inwardly directed, recesses 24 and 25 in which the snap fasteners 18 and the tongue 17 of the handle 12 can be inserted.

Each supporting portion 14 of the vacuum cleaner housing 10 comprises a tube-shaped opening 26, in which the locking sleeve 15 is inserted, the opening 26 being surrounded by means of a circular groove 27 in which the flange portion 20 of the handle part 16 can be inserted. There also are two abutment surfaces 28*a* and 28*b* arranged on a common periphery and separated from one another and limiting the tilting motion of the handle 12 by cooperating with the abutment surfaces 19*a*, 19*b* of the handle part 16.

The handle 12 is mounted by inserting the locking sleeves 15 (which are resilient by the existence of the grooves 23) through the openings 26 from the inside of the vacuum cleaner housing. Each sleeve 15 is rotated to a position such that the tongue 17 of the handle 12 and the snap fasteners 18 can be placed in the recesses 24 and 25. Counterforces are then applied to the locking sleeves 15 so the locking sleeves 15 are not pushed out during mounting. The handle parts 16 are placed at each side of the vacuum cleaner housing 10 such that the cylinder shaped flange portions 20 enter into the grooves 27, thereby inserting the tongues 17 and the snap fasteners 18 into the locking sleeves 15. Continued insertion of the handle 12 causes the snap fasteners 18 to expand and lock the handle 12 at the locking sleeves 15. The handle 12 is prevented from falling out from the openings 26 due to cooperation between the flanges 22 and the surrounding portions of the vacuum cleaner housing 10.

The handle 12 can thus be pivoted between the angles which are defined by the abutment surfaces 19*a*, 19*b*, and 28*a*, 28*b* respectively, the handle 12 being kept in any desired position by means of friction forces between the parts of the handle arrangement 60. The handle arrangement 60 is such that during the pivoting motion of the vacuum cleaner housing 10, the grip portion 12*a* moves at such a distance from the vacuum cleaner housing 10 that the fingers of the operators hand H is generally free from the vacuum cleaner housing 10. It should be mentioned that the friction arrangement could be replaced by other similar means such as a snap fastening arrangement.

It should also be pointed out that due to the handle arrangement 60, the position of the grip part 12*a* with respect to the operator's hand is mainly unchanged during the pivoting motion of the vacuum cleaner housing 10 when the vacuum cleaner 50 is lifted at the same time as the vertical movement of the gravity point is minimized which means that the work of the operator is also minimized.

Although the preferred embodiment of this invention has been shown and described, it should be understood that various modifications and rearrangements of the parts may be resorted to without departing from the scope of the invention as disclosed and claimed herein.

What is claimed is:

1. A vacuum cleaner comprising:

a vacuum cleaner housing;

a handle with a grip portion, said handle being pivotably secured to the vacuum cleaner housing in such a manner that the handle is pivotable about a turning axis that is substantially horizontal and perpendicular to the direction of movement of the vacuum cleaner when the vacuum cleaner is in a working position on a horizontal surface; and means for maintaining the handle in a generally vertical position when the vacuum cleaner is in the working position, and for allowing the vacuum cleaner housing to pivot to a substantially vertical position when an operator lifts the vacuum cleaner housing from the working position by grasping the grip portion with a hand and lifting, the position of said grip portion relative to the operator's hand remaining substantially unchanged during the lifting of the vacuum cleaner housing.

2. The vacuum cleaner according to claim 1, wherein the turning axis is disposed forward of the center of gravity of the vacuum cleaner housing when the vacuum cleaner is in the working position.

3. The vacuum cleaner according to claim 1, wherein the turning axis is disposed below the center of gravity of the vacuum cleaner housing when the vacuum cleaner is in the working position.

4. The vacuum cleaner according to claim 1, wherein the handle can be pivoted between a generally vertical position and a generally horizontal position when the vacuum cleaner is in the working position.

5. The vacuum cleaner according to claim 4, wherein when the handle is in the horizontal position, the handle operates as a bumper for the vacuum cleaner housing.

6. The vacuum cleaner according to claim 1, wherein the handle is generally yoke shaped and is pivotably attached to the vacuum cleaner housing on opposing sides of the vacuum cleaner housing.

7. The vacuum cleaner according to claim 1, wherein the vacuum cleaner housing has a posterior end surface upon which the vacuum cleaner can be stored in a vertical position.

8. The vacuum cleaner according to claim 1, wherein the means for maintaining the handle in a generally vertical position and for allowing the vacuum cleaner housing to pivot comprises:

locking sleeves rotatably disposed in the vacuum cleaner housing; and snap fasteners disposed on opposing ends of the handle and cooperating with the locking sleeves.

9. The vacuum cleaner according to claim 8, wherein the means for maintaining the handle in a generally vertical position and for allowing the vacuum cleaner housing to pivot further comprises:

shoulders on the vacuum cleaner housing; and abutment surfaces on the handle, said abutment surfaces cooperating with the shoulders to limit the pivoting motion of the handle.

10. A vacuum cleaner comprising:

a housing having opposing side walls with openings formed therein;

locking sleeves rotatably disposed in the openings of the side walls; and a handle having opposing ends with projections extending therefrom, said projections being securely received in the locking sleeves, thereby pivotably securing the handle to the housing.

11. The vacuum cleaner of claim 10, wherein the vacuum cleaner is a canister-type vacuum cleaner; and wherein the handle is pivotable about an axis that is disposed forward of the center of gravity of the housing when the vacuum cleaner is in a working position.

12. The vacuum cleaner of claim 11, wherein the axis is disposed below the center of gravity of the vacuum cleaner housing when the vacuum cleaner is in the working position.

13. The vacuum cleaner of claim 12, wherein the handle is generally yoke-shaped.

14. The vacuum cleaner of claim 10, wherein the projections are snap fasteners.

* * * * *